US010811758B2

(12) United States Patent
Lill et al.

(10) Patent No.: US 10,811,758 B2
(45) Date of Patent: Oct. 20, 2020

(54) BROADBAND HF DISMOUNT ANTENNA

(71) Applicant: Harris Global Communications, Inc., Rochester, NY (US)

(72) Inventors: James P. Lill, Rochester, NY (US); Alan A. Scanandoah, Rochester, NY (US)

(73) Assignee: Harris Global Communications, Inc., Rochester, NY (US)

( * ) Notice: Subject to any disclaimer, the term of this patent is extended or adjusted under 35 U.S.C. 154(b) by 162 days.

(21) Appl. No.: 16/009,900

(22) Filed: Jun. 15, 2018

(65) Prior Publication Data

US 2019/0386372 A1 Dec. 19, 2019

(51) Int. Cl.

| | |
|---|---|
| ***H01Q 1/08*** | (2006.01) |
| ***H01Q 1/32*** | (2006.01) |
| ***H01Q 1/52*** | (2006.01) |
| ***H01Q 1/20*** | (2006.01) |

(52) U.S. Cl.

CPC ..... *H01Q 1/085* (2013.01); *H01Q 1/20* (2013.01); *H01Q 1/325* (2013.01); *H01Q 1/52* (2013.01)

(58) Field of Classification Search

CPC ..... H01Q 1/325; H01Q 1/52; H01Q 1/20; H01Q 1/085; H01Q 1/3275; H01Q 9/32; H01Q 9/43

See application file for complete search history.

(56) References Cited

U.S. PATENT DOCUMENTS

| | | | | |
|---|---|---|---|---|
| 4,423,423 | A | 12/1983 | Bush | |
| 7,477,200 | B2 | 1/2009 | Parsche | |
| 2003/0071760 | A1* | 4/2003 | Ngo Bui Hung | H01Q 1/246 343/844 |
| 2012/0249391 | A1* | 10/2012 | Lill | H01Q 1/085 343/793 |
| 2013/0342406 | A1* | 12/2013 | Magid | H01Q 1/32 343/715 |
| 2015/0180137 | A1* | 6/2015 | Eide | H01Q 1/085 343/730 |
| 2018/0254569 | A1* | 9/2018 | LaBarge | H01R 4/66 |

OTHER PUBLICATIONS https://www.bwantennas.com/bwds.html—B&W Barker & Williamson, copyright 2018.

* cited by examiner

*Primary Examiner* — Awat M Salih

(74) *Attorney, Agent, or Firm* — Fox Rothschild LLP; Robert J. Sacco; Carol E. Thorstad-Forsyth

(57) ABSTRACT

Broadband HF antenna system includes a conductive radiating element in the form of a continuous conductive loop. The conductive loop includes first and second elongated conductor portions. The conductive loop is electrically connected at first and second loop ends to an impedance matching network disposed within a chassis. The first elongated conductor portion is comprised of a whip antenna which functions as a cantilevered spring attached at one end to the rigid chassis. The whip antenna is resiliently maintained in a curved state by a tension force applied by the second elongated conductor portion. A spacing or gap between the first and second elongated conductor portions to establish the loop configuration is maintained exclusive of any spacer or hanger element.

19 Claims, 6 Drawing Sheets

BROADBAND HF DISMOUNT ANTENNA

BACKGROUND

Statement of the Technical Field

The technical field of this disclosure comprises antenna systems, and more particularly concerns compact HF antenna systems that are easily deployable in the field.

Description of the Related Art

The high frequency (HF) range of the electromagnetic spectrum remains an important resource for expedient field communications over large geographic areas. The HF frequency range extends from about 3 MHz to 30 MHz and offers various propagation modes such as groundwave, long path skywave and Near Vertical Incidence Skywave (NVIS). Each of these propagation modes are known to offer unique and useful communications capabilities for short range, medium range and long range communications. Moreover, these capabilities are not easily replicated using VHF, UHF or microwave frequencies.

Still, antenna systems for the HF frequency range can present numerous engineering challenges. These challenges can increase when the requirements for the antenna system involve easily deployed, lightweight systems for expedient field communications. Additional challenges arise when the communication needs require that the antenna be configurable for groundwave, long path skywave, and NVIS skywave.

Conventional solutions to the foregoing problems usually involve whip or wire antennas. However, in order to provide solutions over the full range of HF frequencies, these conventional approaches often require the use of antenna couplers (switchable matching networks) or physically large dipole antennas which have been modified to provide increased bandwidth. Examples of these types of antenna can include a Terminated Folded Dipole (TFD) or certain types of ground deployed array antennas. But visual profile and/or deployment time is an issue for both these types of antenna, and their lack of configurability tends to thwarts optimization for different propagation modes.

SUMMARY

This document concerns a broadband HF antenna system. The system is comprised of a rigid chassis containing an impedance matching network. A conductive radiating element is provided in the form of a continuous conductive loop. The conductive loop is comprised of first and second elongated conductor portions. The conductive loop is electrically connected at first and second loop ends to the impedance matching network. According to one aspect, the first elongated conductor portion is comprised of a cantilevered spring attached at one end to the rigid chassis. Advantageously, the cantilevered spring of the first elongated conductor portion can be instantiated as a whip antenna element. The first elongated conductor portion is resiliently maintained in a curved state by a tension force applied by the second elongated conductor portion. According to one aspect, the second elongated conductor portion is advantageously comprised of an elongated flexible wire formed of a conductive material. With the solution disclosed herein, a spacing or gap between the first and second elongated conductor portions, which is necessary to establish the loop configuration, is maintained exclusive of any spacer or hanger element. This result is achieved primarily by means of the curved state of the resilient first elongated conductor portion imparted by the applied tension.

The rigid chassis of the antenna system described herein can include a first connector and a second connector. The first elongated conductor portion is electrically connected at a first end to the first connector, and the second elongated conductor portion can be electrically connected at a second end to the second connector. The first and second elongated conductor portions are electrically connected at a tip end of the first elongated conductor remote from the first end and the rigid chassis to complete the continuous conductive loop. The first elongated conductor portion is responsive to a tension force applied at the tip end by the second elongated conductor portion, whereby the first elongated conductor portion is resiliently conformed to a state of curvature. As a result of this state of curvature, a gap is formed between first elongated conductor portion and the second elongated conductor portion to facilitate the desired loop configuration.

In the solution disclosed herein, the whip antenna functions as a cantilevered spring which is mechanically supported at the first end by the rigid chassis. More particularly, the whip antenna is supported at one end in a fixed orientation in alignment with a first connector axis. Tension applied at an opposing tip end of the whip is maintained in part by a resilient spring force imparted to the second elongated conductor portion by the whip antenna. The tension is also maintained in part by an attachment of the second elongated conductor portion to an anchor lug disposed on the rigid chassis. This anchor lug can be laterally offset from the first connector axis to help facilitate the state of curvature in the whip when tension is applied by the second elongated conductor portion. The rigid chassis is further comprised of a bracket for removably receiving at least one conductive ground rod having a rigid elongated extension configured for insertion into earth.

The impedance matching network that is connected to the antenna radiating element includes a first impedance transformer connected between an input/output port of the antenna system and the first end of the first elongated conductor portion. The matching network also includes a second impedance transformer connected between the second end of the second elongated conductor portion and a resistive termination load.

The solution also concerns a method of forming a broadband HF antenna system. The method involves fixing a whip antenna to an antenna connector disposed on a rigid chassis to establish a first electrical connection to an impedance matching network. An electrical connection is formed at a location distal from the rigid chassis between a first elongated conductor portion comprising the whip antenna and an elongated conductor wire. Consequently, the whip antenna and the elongated conductor wire together define a continuous conductor loop antenna radiating element. The method further involves applying tension to the elongated conductor wire to impart a curvature to the whip antenna, whereby a gap distance is increased between the wire and the whip antenna. This gap distance allows the antenna to have a loop configuration. The elongated conductor wire, while still under tension, is secured to an anchor provided on the rigid chassis so as to maintain the tension. Further, the elongated conductor wire is connected to a second antenna connector disposed on the rigid chassis to establish a second electrical connection to the impedance matching network.

BRIEF DESCRIPTION OF THE DRAWINGS

This disclosure is facilitated by reference to the following drawing figures, in which like numerals represent like items throughout the figures, and in which.

DETAILED DESCRIPTION

Figure 1:
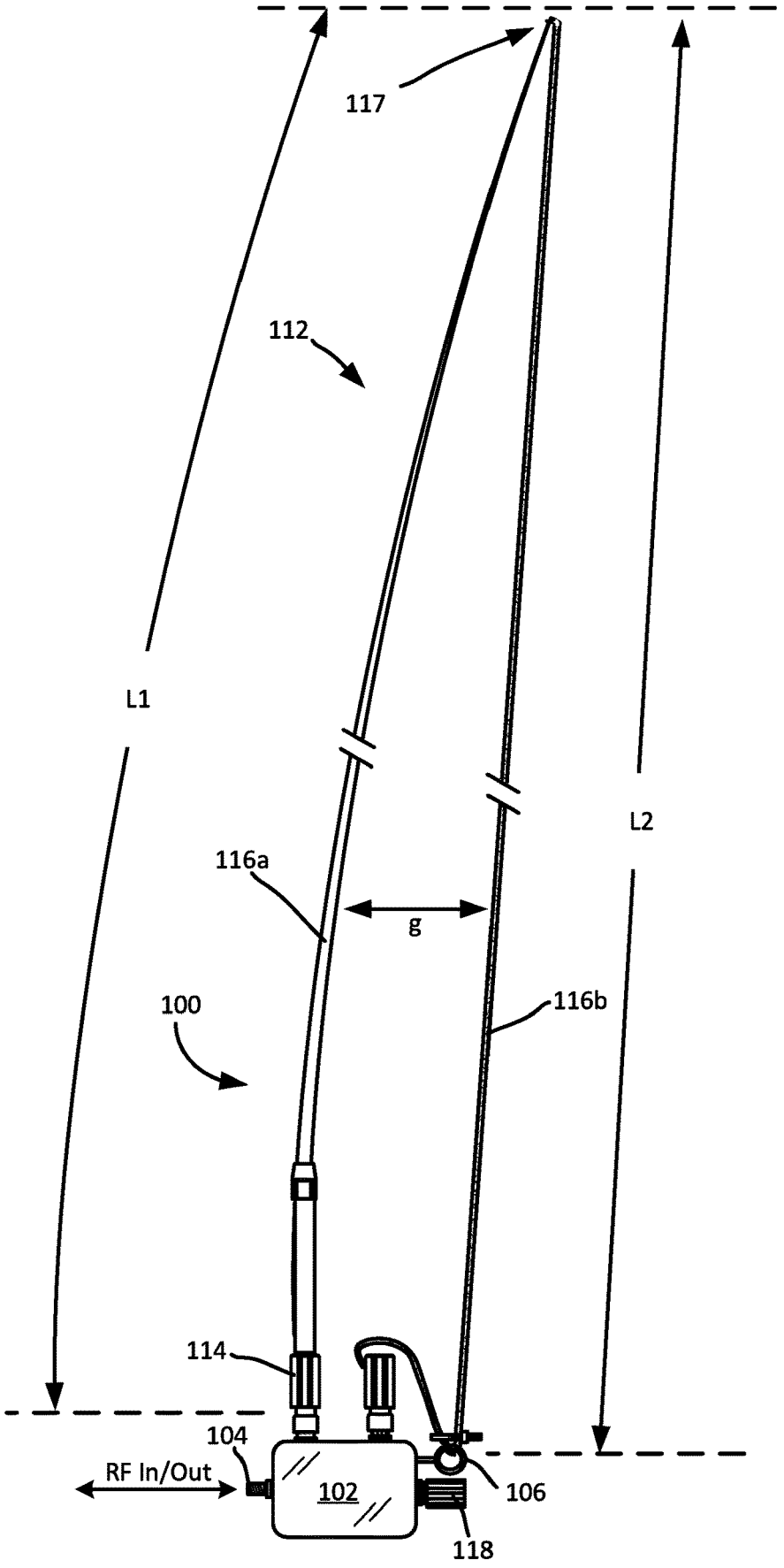
FIG. 1 is an drawing which is useful for understanding a broadband HF antenna system.

It will be readily understood that the components of the systems and/or methods as generally described herein and illustrated in the appended figures could be arranged and designed in a wide variety of different configurations. Thus, the following more detailed description, as represented in the figures, is not intended to limit the scope of the present disclosure, but is merely representative of certain implementations in various different scenarios. While the various aspects are presented in the drawings, the drawings are not necessarily drawn to scale unless specifically indicated.

A solution is presented herein for a field expedient antenna for HF communications. The antenna system is easy to set up and easily reconfigurable for groundwave, long path skywave, and NVIS skywave. Further, the antenna provides a broad impedance bandwidth across a wide range of HF frequencies extending from 2 MHz to 30 MHz. A further advantage of the solution presented herein is that it can be conveniently deployed on both soil and on vehicles.

Figure 2:
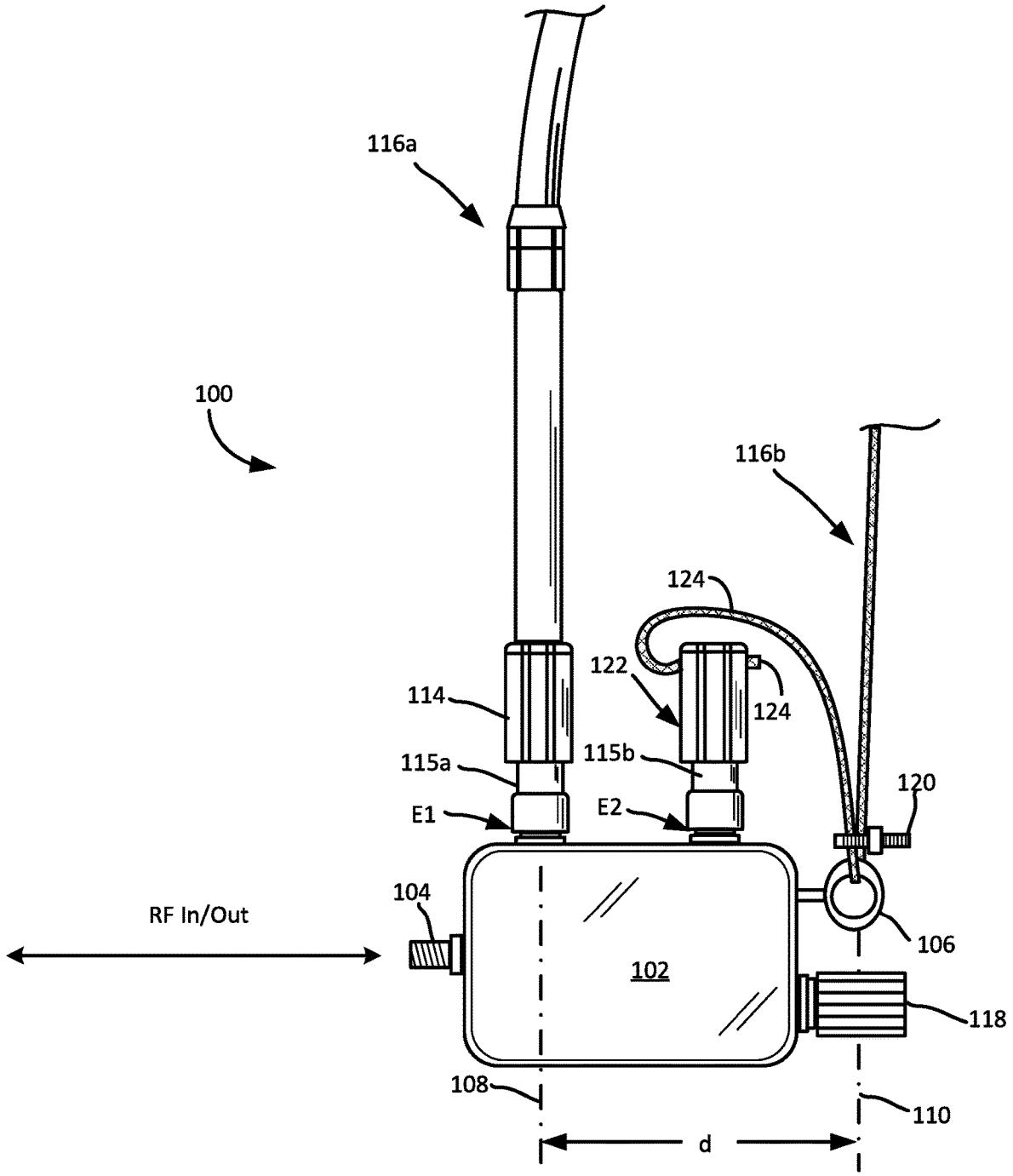
FIG. 2 is a drawing showing an enlarged chassis portion of the antenna system in FIG. 1, which shows in greater detail an input port, chassis electrical connectors for the antenna radiating element, and an anchor lug.

It can be observed in FIGS. 1 and 2 that an antenna system 100 is comprised of a chassis 102 formed of a rigid material. The chassis comprises a compact housing or enclosure having an internal space (not shown) in which an electronic matching circuit is disposed. The electronic matching circuit provided in the chassis 102 is described in greater detail with respect to FIG. 4. The antenna system 100 is intended as a man-portable system and it can therefore be advantageous to limit the size of the chassis 102 to be less than about 30 centimeters per side. For example, in some scenarios the chassis can be less than 15 centimeters in length per side. Still, it will be understood as the discussion progresses that the exact dimensions of the chassis 102 are not critical.

According to one aspect, the chassis 102 can form a sealed enclosure which is arranged to prevent ingress of water and/or other environmental contaminants into the internal space. In some scenarios, the chassis 102 can be comprised of a highly conductive material such as aluminum or copper. As such, the chassis 102 can be comprised of a metal casting or machined enclosure with a removable cover. In other scenarios, the chassis could be machined or molded of a polymer material (such as a fiber reinforced polymer) and a conductive metal lining. The metal casting or metal lining is advantageous to facilitate a chassis electrical ground and to electrically shield the internal electronic matching circuit.

The chassis 102 will have an RF port 104 through which RF signals can be communicated to and from the antenna. For example, in some scenarios RF signals can be communicated to and from the antenna system and a radio frequency transceiver. A suitable transmission line used for this purpose can be any type of RF transmission line now known or known in the future. In some scenarios, the RF port can be comprised of a coaxial connector to facilitate fast and convenient connection of a coaxial cable type transmission line. It should be noted that the antenna system 100 can be used for receiving operations in which received RF signals which excited one or more antenna elements are communicated from the antenna system to a radio frequency receiver through the RF port 104. The antenna system 100 can also be used for transmitting operations in which the antenna system receives at RF port 104 an RF signal from a radio frequency transmitter and couples the RF energy to one or more radiating elements. The receiver and transmitter described herein can be part of a transceiver system, in which the antenna system is used for transceiver operations.

The antenna system 100 includes an antenna radiating element 112. The antenna radiating element 112 is comprised of a first elongated portion 116*a* and a second elongated portion 116*b*. The first elongated portion 116*a* has a length L1 which can be approximately the same or longer than a length L2 of the second elongated portion 116*b*. In some scenarios at least one portion of the antenna radiating element 112 can be a whip type of antenna. In other scenarios, at least one portion of the antenna radiating element 112 can be comprised of an elongated conductor such as a conductive metal wire. According to one aspect, the antenna radiating element 112 can be comprised of a whip antenna and an elongated conductive metal wire which are electrically connected in series. For example, such a scenario is shown in FIGS. 1 and 2 which illustrate that a first elongated portion 116*a* of the antenna radiating element 112 is a whip antenna, and a second elongated portion 116*b* of the antenna radiating element 112 is an elongated flexible conductive wire.

Figure 3:
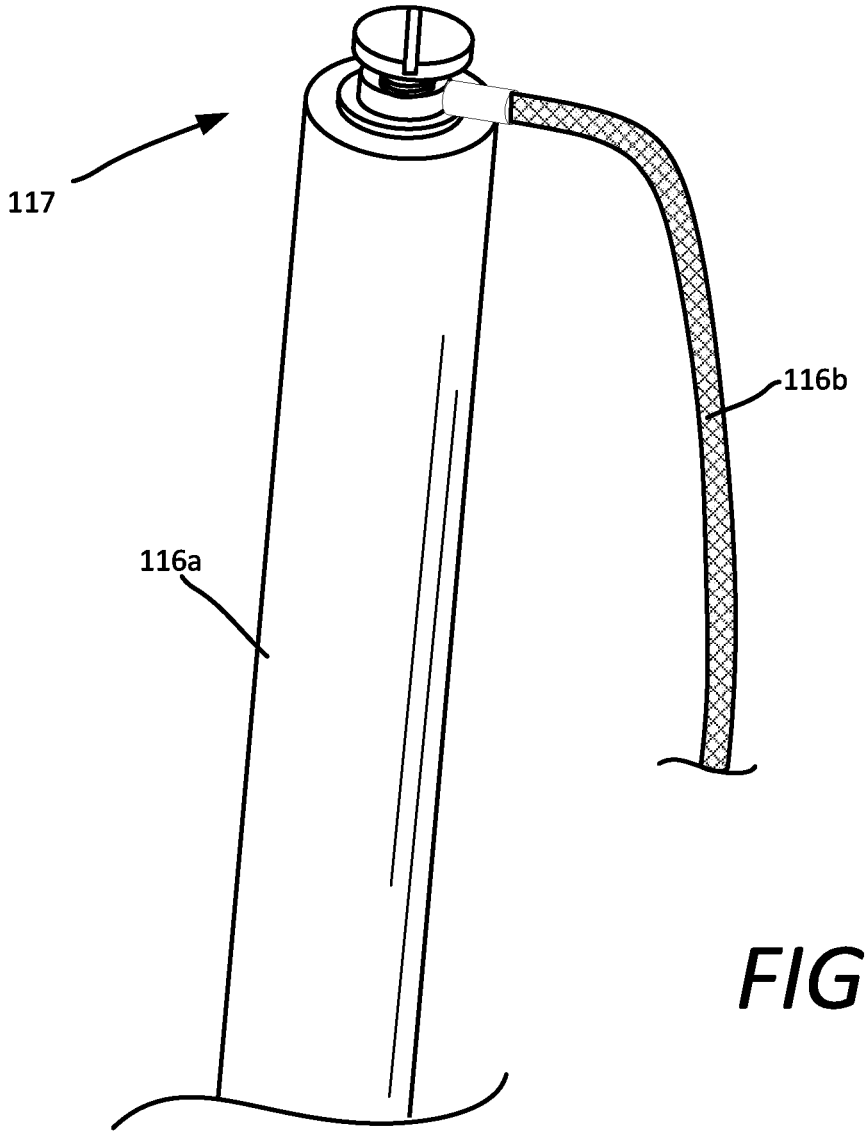
FIG. 3 is an enlarged view showing where a tip end of a first elongated portion in the form of a whip antenna is electrically and mechanically connected to a second elongated portion of the antenna radiating element.

As shown in FIG. 3, the first and second elongated portions 116*a*, 116*b* are securely connected at tip end 117. This connection at tip end 117 will include an electrical connection of the elongated conductors which comprise the second elongated portion 116*b* and the first elongated portion 116*a* so that an electrically continuous antenna radiating element 112 is provided. This connection formed at the tip end can be facilitated by any suitable arrangement, such as a screw terminal, spring clamp, and so on. Advantageously, the connection can be a releasable type of electrical connection so that, when necessary, the whip antenna can be used independently. The electrical connection is also advantageously formed so that it is mechanically robust to withstand a tension force applied at the connection. The purpose of this tension force is described below in greater detail.

The exact length of a whip antenna used to implement the first elongated portion 116*a* is not critical. However, a suitable whip can have a length between about 1 to 6 meters. In some scenarios, the whip can have a length of about 2 to 4 meters. An example of a whip antenna which can be used for this purpose can be similar to an OE-505 type whip antenna which is commercially available from Harris Corporation of Melbourne, Fla., and has a length of about 3 meters.

Whip antennas are well-known and therefore will not be described here in detail. However, it should be understood that a whip antenna is comprised of an elongated flexible rod with a connector 114 provided at a feed end. The whip antenna will comprise an elongated conductive member which serves as a radiating element. The elongated conductive member can extend substantially along the entire length of the whip antenna from the connector 114 to a tip end 117, which is distal from the connector 114. The connector 114 can physically support the whip antenna on a corresponding chassis connector and will provide an electrical connection to the radiating element portion of the whip antenna. In some scenarios, the resilient flexibility of the whip antenna can be facilitated by a resilient and flexible metal rod which can also comprise the radiating element. In other scenarios, the flexibility of the whip can be at least partially provided by an elongated outer radome structure which encases and protects the elongated conductive radiator element disposed therein. The outer radome structure in such scenarios can be formed of a fiber reinforced plastic material or any other suitable material which exhibits low loss to RF signals.

The chassis 102 includes several functional components to facilitate structural connection of the antenna radiating element 112 to the chassis, and electrical connection of the antenna radiating element 112 to the antenna matching circuit internal of the chassis. These functional components can include a first chassis connector 115*a*, a second chassis connector 115*b*, and an anchor lug 106. The first chassis connector 115*a* can be configured to facilitate an electrical connection between an antenna matching circuit internal to the chassis 102, and a first elongated portion 116*a* of an antenna radiating element 112. The second chassis connector 115*b* is provided to facilitate an electrical connection between the antenna matching circuit internal to the chassis 102, and a second elongated portion 116*b* of an antenna radiating element 112. The first and second chassis connectors can similarly facilitate a mechanical connection to the chassis of the first and second elongated portions 116*a*, 116*b* of the antenna radiating elements.

In some scenarios, the first chassis connector 115*a* can be configured for receiving a connector 114 of a whip antenna used to implement the first elongated portion 116*a* of an antenna radiating element 112. As such, the connector 114 and the first chassis connector 115*a* can each be threaded, keyed or otherwise configured to facilitate secure removable attachment of the whip antenna to the chassis 102, while also electrically connecting the conductive radiating element of the whip antenna to the internal matching circuitry at E1.

The second chassis connector 115*b* can be conventional cable lug to facilitate connection of a conductive wire. For example, such a cable lug could comprise a mechanical lug assembly which includes a clamping element. The clamping element is threaded onto the lug, spring biased or removably fixed in a way which facilitates secure connection of a conductive wire to the cable lug. Conventional cable lugs of this kind are well-known in the art and therefore will not be described in detail.

However, in other scenarios, it can be advantageous to arrange the second chassis connector 115*b* to have a configuration which is similar to the first chassis connector 115*a*. As such, the second chassis connector 115*b* can be configured for receiving a connector of a whip antenna. In this regard, the second chassis connector 115*b* can be threaded, keyed or otherwise configured to facilitate secure attachment of a whip antenna to the chassis 102, while also facilitating an electrical connection of the conductive radiating element of the whip antenna to the internal matching circuitry at E2. According to one aspect, the first and second chassis connectors 115*a*, 115*b* and the connector 114 can each conform to a defined standard for a whip antenna connector. For example, the first and second chassis connectors 115*a*, 115*b* can be conventional standard type of RF connector that is commonly used for RF signals. An example of this type of connector can include a conventional N type antenna connector, a PL-259 type connector or an NMO type of connector. Of course, other types of standardized RF connectors can also be used for this purpose.

If second chassis connector 115*b* is a standardized RF connector, then an adapter 122 can be provided to receive within the adapter a terminal end portion 124 of a conductive wire which comprises the second elongated portion 116*b* of antenna radiating element 112. For example, such an adapter 122 could comprise a simple mechanical lug assembly which includes a spring-biased clamping element (not shown). Such an arrangement can facilitate fast and secure connection of a conductive wire to the second chassis connector 115*b*, while still permitting the second chassis connector to be used under certain circumstances for receiving a whip antenna.

The chassis 102 also includes an anchor lug 106. The anchor lug 106 is secured to the chassis 102 at a location that is laterally offset from a central axis associated with the first chassis connector 115*a*. This lateral offset is best understood with reference to FIG. 2, which shows that first chassis connector 115*a* has a central axis 108 which is laterally offset from the anchor lug retention axis 110. According to one aspect, this lateral offset can comprise a distance d, where d has a magnitude of between about 2.5 to 10 centimeters. In some scenarios, the distance d can be somewhat larger (e.g., between 10 to 20 centimeters, or 15 to 30 centimeters). In fact, the exact distance d is not critical provided that (1) the chassis 102 remains as a compact man-portable unit, and (2) the distance d is sufficient to facilitate an arc or bowing effect to the first elongated portion 116*a* of the antenna radiating element 112, when the first elongated portion 116*a* is a whip antenna, and the second elongated portion 116*b* is tensioned as shown.

The second elongated portion 116*b* (e.g., which may be conductive metal wire) is manually tensioned to facilitate a desired bowing effect upon the whip antenna. While tensioned, the second elongated portion 116*b* is secured to the anchor lug 106 using a restraining element 120. The restraining element 120 can be provided in the form of a cable tie, clamp, strap or cinch which, when properly secured to the second elongated portion 116*b*, will prevent it from moving relative to the anchor lug 106. As such, the tension exerted by the second elongated portion 116*b* (and the bowing effect upon the whip antenna) can be maintained without further user intervention. So the anchor lug 106 and the restraining element 120 serve to fix the necessary tension to the second elongated portion 116*b*, and also provide strain relief to the wire terminal end portion 124.

For proper operation, the radiating element should be isolated from the chassis 102. Accordingly, the various elements used to anchor the second elongated portion 116*b* should be chosen to prevent the second elongated portion from forming an electrical connection with the chassis 102. For example, in some scenarios the anchor lug 106 can be comprised of an insulating material to prevent any exposed conductor of the second elongated portion from coming into electrical contact with the chassis 102. A similar effect could be achieved by choosing the second elongated portion 116*b* to have an insulated outer covering or sheath. Alternatively, a dielectric insulator (not shown) could be disposed between the anchor lug and the second elongated portion to ensure the necessary electrical isolation. The exact isolation method is not critical provided that it is sufficiently robust to withstand the tension produced by the whip antenna and ensures adequate electrical isolation.

The antenna system shown in FIGS. 1-3 is basically a shortened broadband loop antenna. In order to make such antennas effective, it is necessary to separate the conductors which form the loop a sufficient distance. The combination of the lateral offset distance d, the flexing of the resilient whip antenna, the tension provided by the second elongated portion 116*b*, and the difference in length between L1 and L2 will cause a bowing of the whip antenna similar to that shown in FIG. 1. Such bowing will in turn facilitate a gap between the first and second elongated portions 116*a*, 116*b* which varies in distance along the length of the antenna radiating element 112. As may be observed in FIG. 1, the exact gap distance g between the whip antenna and the second elongated portion 116*b* will vary along the length of the whip antenna. In general, it is advantageous to maximize the size of the gap. In the solution presented herein, by bowing the whip in a manner similar to that shown in FIGS. 1-3, it has been determined that a gap having a maximum gap of between about 20 to 25 centimeters can be formed between the whip antenna which comprises first elongated portion 116*a* and the wire which comprises second elongated portion 116*b*. On average, this distance can be about 15 centimeters with a moderate amount of bowing or flexing with respect to the whip. Although this distance is somewhat less than many conventional loop antenna designs, it has nevertheless been determined to be sufficient to effectively define an antenna having characteristics of a loop type antenna.

Note that the gap g defined between the first and second elongated portions 116*a*, 116*b* is advantageously achieved and fixed without the use of structural components such as rigid spacers or hangers. Accordingly, the arrangement disclosed herein facilitates a loop antenna which is extremely lightweight and compact. The assembled antenna is free-standing, holds its loop shape, and yet does not require any spacers, hangers or support members (other than the whip antenna) to support the radiating element 112. The whip antenna in this configuration essentially functions as a cantilevered support structure which is secured at the chassis 102, and concurrently serves as a spacer element to maintain a gap between the first and second elongated portions 116*a*, 116*b* which define the radiating element 112.

Figure 4:
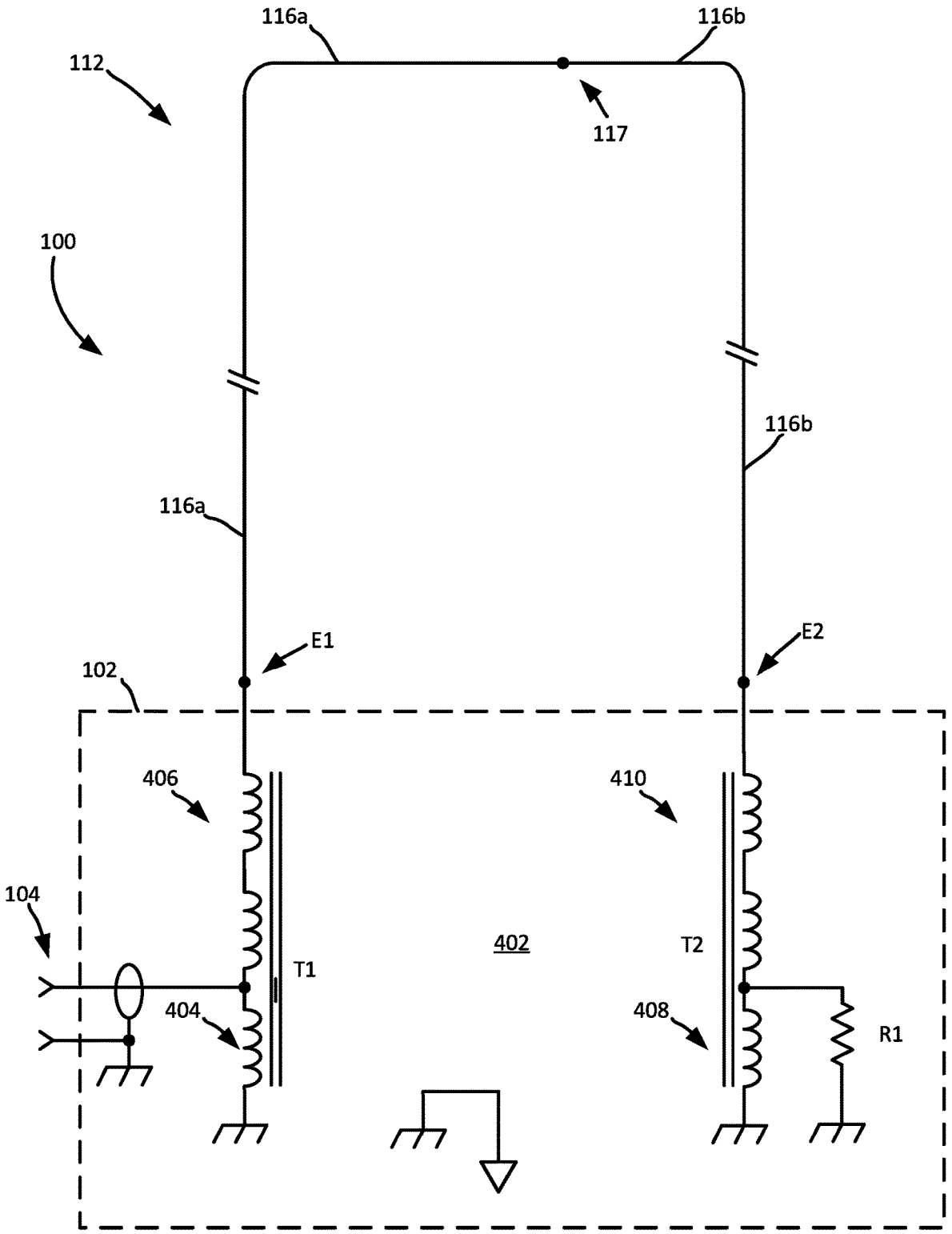
FIG. 4 is a schematic diagram that is useful for understanding the antenna system 100.

Turning now to FIG. 4, there is shown a schematic representation of the antenna system 100 which includes a matching circuit 402. The matching circuit is comprised of RF input 104, impedance transformers T1, T2, and a termination load R1. In the example shown, each of the impedance transformers T1 and T2 are autotransformers comprised of one winding. As such, a portion of the winding of each transformer is common to both the primary and the secondary circuit. In the example shown, T1 and T2 can be identical transformers, each having a 9:1 transformer ratio. However, it should be understood that the transformers are not limited to this particular ratio or the configuration shown. Any other type of impedance transformer now known or known in the future can be used for this purpose provided that it achieves the desired impedance transformation.

The impedance transformation selected in a particular scenario can be chosen based on a variety of factors such as the overall length of the radiating element 112, the distance g comprising the gap between the first and second elongated portions 116*a*, 116*b*, the output impedance of a transceiver used with the antenna system 100, and the impedance of a transmission line which is used to feed the antenna system. The termination load R1 is shown in FIG. 4 as internal to the chassis 102. However, it can be convenient in some scenarios to instead provide R1 as an external load 118 so that a value of R1 can be more easily changed in the field. In the example shown, R1 is a 50 Ohm termination load, but it should be understood that other load values are also possible. Further, in some scenarios it can be advantageous to replace the combination of R1 and T2 with a single resistor. The resistor in such a scenario will advantageously have a resistance value which is greater than 50 Ohms. This single resistor can be disposed internal to the chassis 102 as shown in FIG. 4, or can be made accessible from the exterior of the chassis as an external load 118.

As shown in FIG. 4, the primary winding 404 of transformer T1 is connected at one end to the chassis ground and at a second end to the RF input 104. The secondary winding 406 of T1 is connected at one end to the primary winding 404 and the RF input 104. A second end of the secondary winding 406 is connected at (E1) to the first elongated portion 116*a* of the antenna radiating element 112. The primary winding 408 of transformer T2 is connected at one end to the chassis ground, and at a second end to termination load resistor R1. The secondary winding 410 is connected to a second end of the primary winding 408 and to termination load resistor R1. A second end of the secondary winding 410 is connected at (E2) to the second elongated portion 116*b* of the antenna radiating element 112.

Figure 5A:
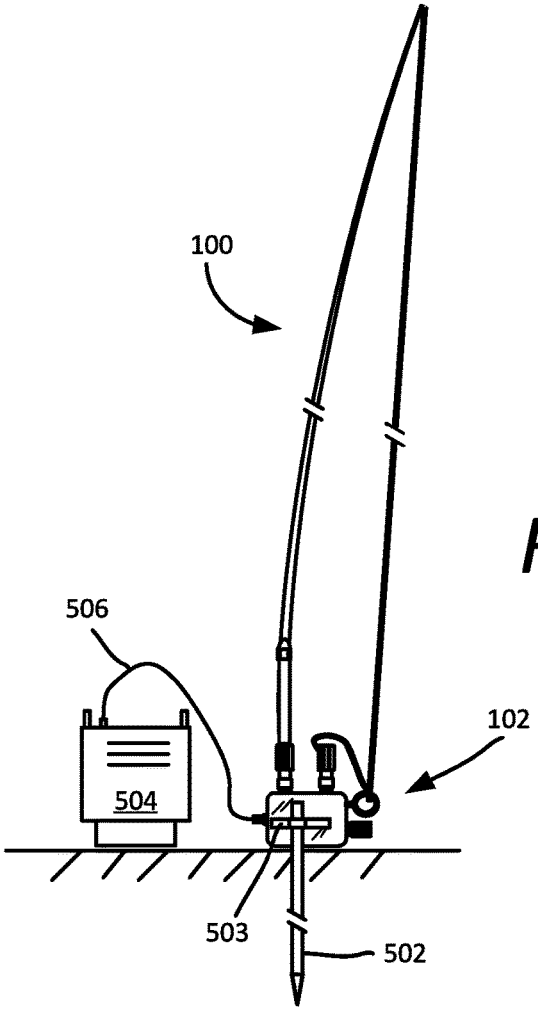
FIG. 5A-5C are a series of drawing which are useful for understanding how the antenna system 100 can be used in various scenarios for local groundwave, NVIS and long range skywave.

The antenna system 100 can provide satisfactory performance for local groundwave, NVIS and long distance skywave types of HF communication. Further, the antenna system 100 can mount to a ground rod, a vehicle, or directly to a radio transceiver (e.g. a manpack type radio transceiver). Shown in FIG. 5A is a scenario in which the antenna system 100 is mounted to a single ground rod 502. The ground rod 502 is secured to the chassis 102 by suitable means such as a clip, bracket or clamp 503 which is attached to the rigid chassis 102. The clip, bracket or clamp is advantageously configured for removably receiving at least one conductive ground rod having a rigid elongated extension configured for insertion into earth. The ground rod is electrically connected to the chassis 102 and inserted into the earth to facilitate an earth ground for the antenna system. In some scenarios, more than one ground rod 502 can be provided to facilitate greater stability for the chassis 102. A transceiver 504 is coupled to the antenna system 100 by means of a coaxial cable 506. In this scenario, the antenna system 100 functions as a vertical loop.

Figure 5B:
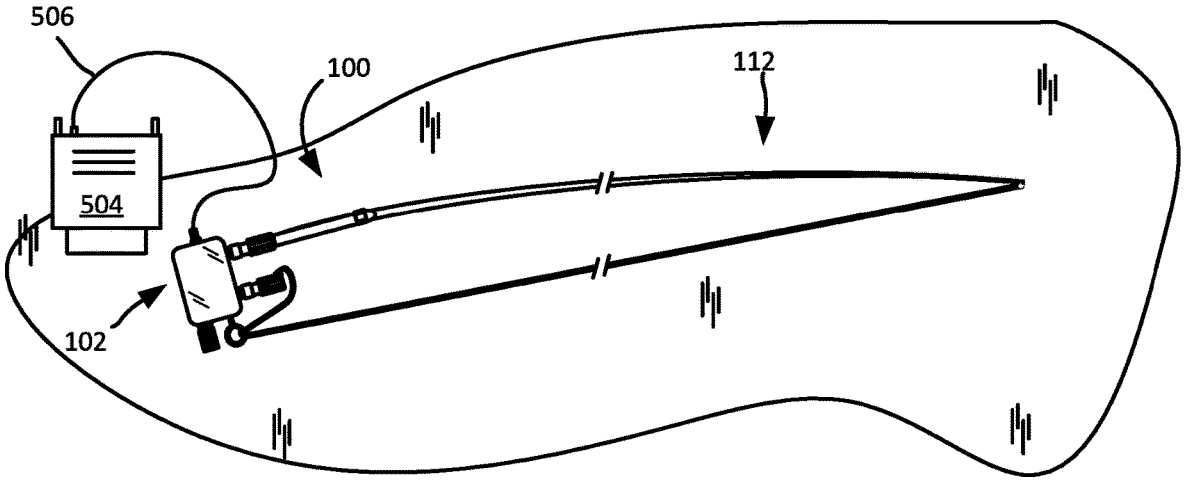
Figure 5C:
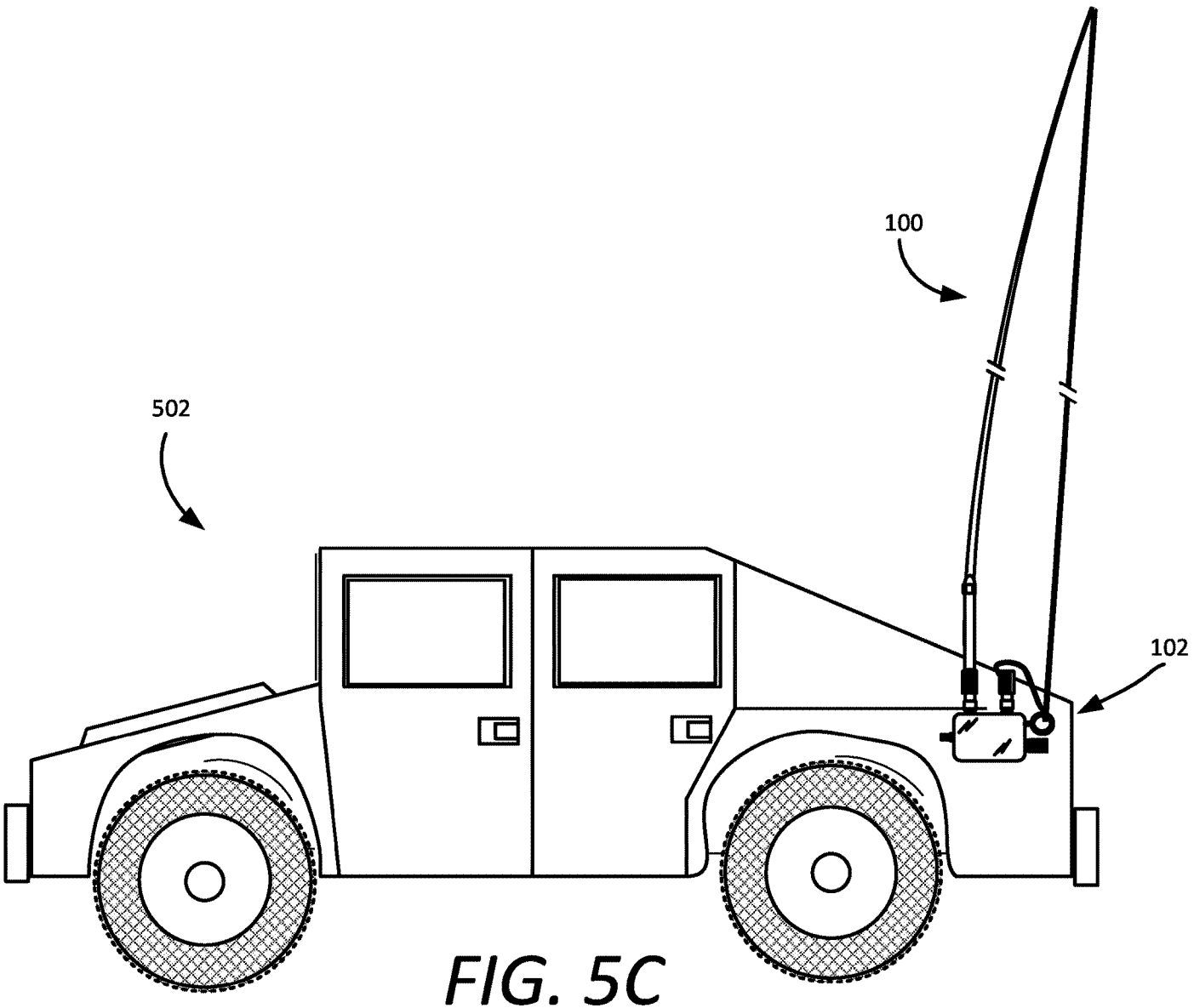

In an alternative scenario shown in FIG. 5B, the antenna system can be arranged so that the radiating element 112 is disposed horizontally so that it is slightly above or directly on the ground. In this configuration, the system operates as a horizontally oriented loop antenna. A further advantage of the antenna system 100 is that it eliminates the need for an antenna coupler which is sometimes required between the transceiver and antenna for impedance matching purposes. A third scenarios is shown in FIG. 5C in which the antenna system 100 is mounted to a vehicle 502.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A broadband HF antenna system, comprising a rigid chassis having a first connector and a second connector; and a conductive radiating element in the form of a single continuous conductive loop, the single continuous conductive loop comprised of:

a first elongated conductor portion electrically connected at a first end to the first connector, and a second elongated conductor portion electrically connected at a second end to the second connector;

wherein the first elongated conductor portion is electrically releasably connected at a tip end of the second elongated conductor that is remote from the rigid chassis and opposed from the second end; and wherein the first elongated conductor portion is responsive to a pulling tension directly applied to the tip end by the second elongated conductor portion, whereby the first elongated conductor portion is resiliently conformed to a state of curvature in which a variable sized gap is defined between the first elongated conductor portion and the second elongated conductor portion.

2. The broadband HF antenna system according to claim 1, wherein the first elongated conductor portion is part of a whip antenna element.

3. The broadband HF antenna system according to claim 2, wherein the whip antenna element is mechanically supported on the rigid chassis at the first end in a fixed orientation aligned with a first connector axis so as to define a cantilevered spring.

4. The broadband HF antenna system according to claim 3, wherein the tension is maintained in part by a resilient spring force imparted to the second elongated conductor portion by the whip antenna element when conformed to the state of curvature.

5. The broadband HF antenna system according to claim 4, wherein the tension is maintained in part by an attachment of the second elongated conductor portion to an anchor lug disposed on the rigid chassis.

6. The broadband HF antenna system according to claim 5, wherein the anchor lug is laterally offset from the first connector axis.

7. The broadband HF antenna system according to claim 1, further comprising an impedance matching network connected to the conductive radiating element.

8. The broadband HF antenna system according to claim 7, wherein the impedance matching network includes a first impedance transformer connected between an input/output port of the antenna system and the first end of the first elongated conductor portion.

9. The broadband HF antenna system according to claim 8, wherein the impedance matching network includes a second impedance transformer connected between the second end of the second elongated conductor portion and a resistive termination load.

10. The broadband HF antenna system according to claim 1, wherein the rigid chassis is further comprised of a bracket for removably receiving at least one conductive ground rod having a rigid elongated extension configured for insertion into earth.

11. A broadband HF antenna system, comprising a rigid chassis containing an impedance matching network;

a radiating element in the form of a single continuous conductive loop comprised of a first and second elongated conductor portions electrically connected to the impedance matching network;

the first elongated conductor portion attached at a proximal end to the rigid chassis, attached at a distal end directly to a distal end of the second elongated conductor portion, and resiliently urged to a curved state by a tension pulling force applied by the second elongated conductor portion directly to the first elongated conductor portion; and the second elongated conductor portion comprises an elongated flexible wire, and a proximal end that is coupled to the rigid chassis;

wherein a spacing between the first and second elongated conductor portions necessary to establish the single continuous conductive loop is maintained exclusive of any spacer or hanger element.

12. The broadband HF antenna system according to claim 11, wherein the first elongated conductor portion is a part of a whip antenna.

13. A method of forming a broadband HF antenna system, comprising:

fixing a whip antenna to a first antenna connector disposed on a rigid chassis to establish a first electrical connection to an impedance matching network;

forming at a location distal from the rigid chassis an electrical connection directly between a first elongated conductor portion of the whip antenna and an elongated conductor wire to define a single continuous conductor loop antenna radiating element;

applying a tension pulling force by the elongated conductor wire to impart a curvature to the whip antenna, whereby a gap distance changes value between the elongated conductor wire and the whip antenna along an elongate length of the single continuous conductor loop antenna radiating element;

releasably securing the elongated conductor wire to an anchor provided on the rigid chassis so as to maintain the tension; and electrically connecting the elongated conductor wire to a second antenna connector disposed on the rigid chassis to establish a second electrical connection to the impedance matching network.

14. The method according to claim 13, further comprising selecting the location of the anchor on the rigid chassis to be laterally offset from an axis of the first antenna connector.

15. The method according to claim 14, further comprising electrically isolating the elongated conductor wire from the rigid chassis.

16. The method according to claim 13, further comprising coupling the impedance matching network to an RF communication device selected from a group consisting of a receiver, a transmitter and a transceiver.

17. The method according to claim 16, further comprising removably securing a ground rod to the rigid chassis and inserting the ground rod into earth.

18. The method according to claim 17, wherein the ground rod is inserted into the earth so that the rigid chassis maintains the whip antenna in an orientation that extends transversely to a surface of the earth to facilitate radio communications with the antenna system.

19. The method according to claim 16, further comprising disposing the rigid chassis on a surface of the earth in an orientation which maintains the whip antenna in a direction that extends parallel to the surface of the earth to facilitate radio communications with the antenna system.

* * * * *